US011794493B2

(12) United States Patent
Motohashi

(10) Patent No.: US 11,794,493 B2
(45) Date of Patent: Oct. 24, 2023

(54) INK-JET PRINTING APPARATUS, PRINT CONTROL METHOD, AND PROGRAM

(71) Applicant: KONICA MINOLTA, INC., Tokyo (JP)

(72) Inventor: Katsuya Motohashi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 323 days.

(21) Appl. No.: 16/936,463

(22) Filed: Jul. 23, 2020

(65) Prior Publication Data

US 2021/0078341 A1 Mar. 18, 2021

(30) Foreign Application Priority Data

Sep. 12, 2019 (JP) ..... 2019-166249

(51) Int. Cl.

*B41J 11/00* (2006.01)
*B41J 29/393* (2006.01)
*B41J 19/20* (2006.01)

(52) U.S. Cl.

CPC ..... *B41J 11/007* (2013.01); *B41J 11/0095* (2013.01); *B41J 19/205* (2013.01); *B41J 29/393* (2013.01)

(58) Field of Classification Search

CPC .. B41J 25/308; B41J 2/04573; B41J 2/04556; B41J 11/20; B41J 11/007; B41J 11/0095; B41J 11/0035; B41J 25/3088; B41J 29/393; B41J 11/008; B41J 19/205; B41J 29/38

See application file for complete search history.

(56) References Cited

U.S. PATENT DOCUMENTS

| | | | | |
|---|---|---|---|---|
| 8,757,757 | B2 | 6/2014 | Takeuchi et al. | |
| 10,328,728 | B2 | 6/2019 | Takagi et al. | |
| 2018/0037037 | A1* | 2/2018 | Takagi | B41J 11/46 |
| 2020/0101773 | A1* | 4/2020 | Mizutani | B41J 29/38 |

FOREIGN PATENT DOCUMENTS

| | | | |
|---|---|---|---|
| JP | 2011240491 | A | 12/2011 |
| JP | 2016144895 | A | 8/2016 |
| JP | 2017128130 | A | 7/2017 |
| WO | 2016009941 | A1 | 1/2016 |

OTHER PUBLICATIONS

Japanese Office Action (and an English language translation thereof) dated Jun. 20, 2023, issued in counterpart Japanese Application No. 2019-166249.

* cited by examiner

*Primary Examiner* — Jannelle M Lebron

(74) *Attorney, Agent, or Firm* — Holtz, Holtz & Volek PC

(57) ABSTRACT

An ink-jet printing apparatus includes: a conveying part that conveys a print medium; a plurality of discharge heads that is arranged along a direction of conveying the print medium, and discharges ink onto the print medium to perform printing an the print medium; a moving part that moves the discharge heads such that distances between the print medium and the discharge heads are changed from a set distance; and a hardware processor that controls printing on the print medium, wherein the hardware processor corrects a print distance such that the print distance is changed from a predetermined value in response to the discharge heads being moved in such a way as to change the distances between the print medium and the discharge heads, the print distance being a conveying distance of the print medium to be conveyed while printing on the print medium is performed by the discharge heads.

13 Claims, 11 Drawing Sheets

INK-JET PRINTING APPARATUS, PRINT CONTROL METHOD, AND PROGRAM

The entire disclosure of Japanese patent Application No. 2019-166249, filed on Sep. 12, 2019, is incorporated herein by reference in its entirety.

BACKGROUND

Technological Field

The present invention relates to an Ink-jet printing apparatus, a print control method, and a program.

Description of the Related Art

Heretofore, there is known an ink-jet printing apparatus including a discharge head that discharges ink onto a cloth sheet to form an image.

For example, JP 2017-128130 A discloses an ink-jet printing apparatus that includes a plurality of discharge heads and a lifting mechanism. The plurality of discharge heads is arranged along the direction of conveyance of a cloth sheet to be conveyed in a predetermined direction. The lifting mechanism changes distances between the cloth sheet and the discharge heads by vertically moving the discharge heads.

Incidentally, when a cloth sheet is located at a normal height and the discharge head is located at a normal position (position to be set in the case of printing on a cloth sheet), the distance between the cloth sheet and the discharge head is appropriate (set distance). However, for example, since a seam between cloth sheets is thicker than other parts of the cloth sheets, there is a possibility that the distance between the cloth sheet and the discharge head may decrease to cause the cloth sheet and the discharge head to interfere with each other. Furthermore, for example, if there is a foreign substance on a cotton cloth sheet, there is a possibility that the foreign substance and the discharge head may interfere with each other.

In order to avoid interference between a seam or foreign substance and the discharge head, the lifting mechanism moves the discharge head upward from the normal position to a standby position. As a result, the distance between the cloth sheet and the discharge head becomes larger than the set distance. In the case where the distance between the cloth sheet and the discharge head is larger than the set distance, printing on the cloth sheet may lead to deterioration in image quality. As a result of partial deterioration in image quality, not only a normal image quality part (part A shown in FIG. 1) but also a deteriorated image quality part (part B shown in FIG. 1) are included in a target print amount. Therefore, there is a problem that it is not possible to achieve a target print amount with normal image quality.

SUMMARY

An object of the present invention is to provide an ink jet printing apparatus, a print control method, and a program that can achieve a target print amount with normal image quality even in the case of partial deterioration in image quality.

To achieve the abovementioned object, according to an aspect of the present invention, an ink jet printing apparatus reflecting one aspect of the present invention comprises: a conveying part that conveys a print medium; a plurality of discharge heads that is arranged along a direction of conveying the print medium, and discharges ink onto the print medium to perform printing on the print medium; a moving part that moves the discharge heads such that distances between the print medium and the discharge heads are changed from a set distance; and a hardware processor that controls printing on the print medium, to be performed by the discharge heads, wherein the hardware processor corrects a print distance such that the print distance is changed from a predetermined value in response to the discharge heads being moved in such a way as to change the distances between the print medium and the discharge heads, the print distance being a conveying distance of the print medium to be conveyed while printing on the print medium is performed by the discharge heads.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
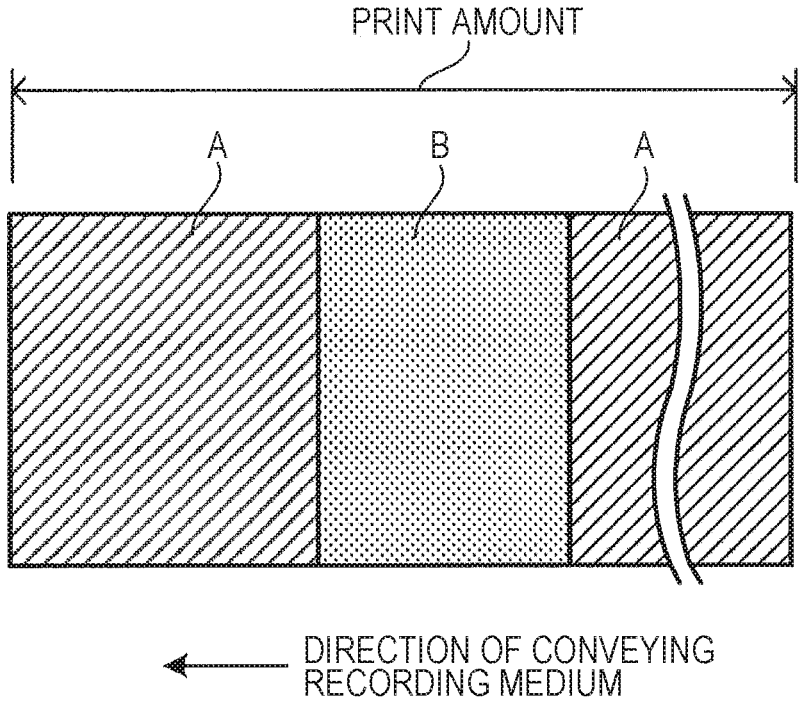
FIG. 1 is a diagram showing a relationship between a print amount and a part with deteriorated image quality.
Figure 2:
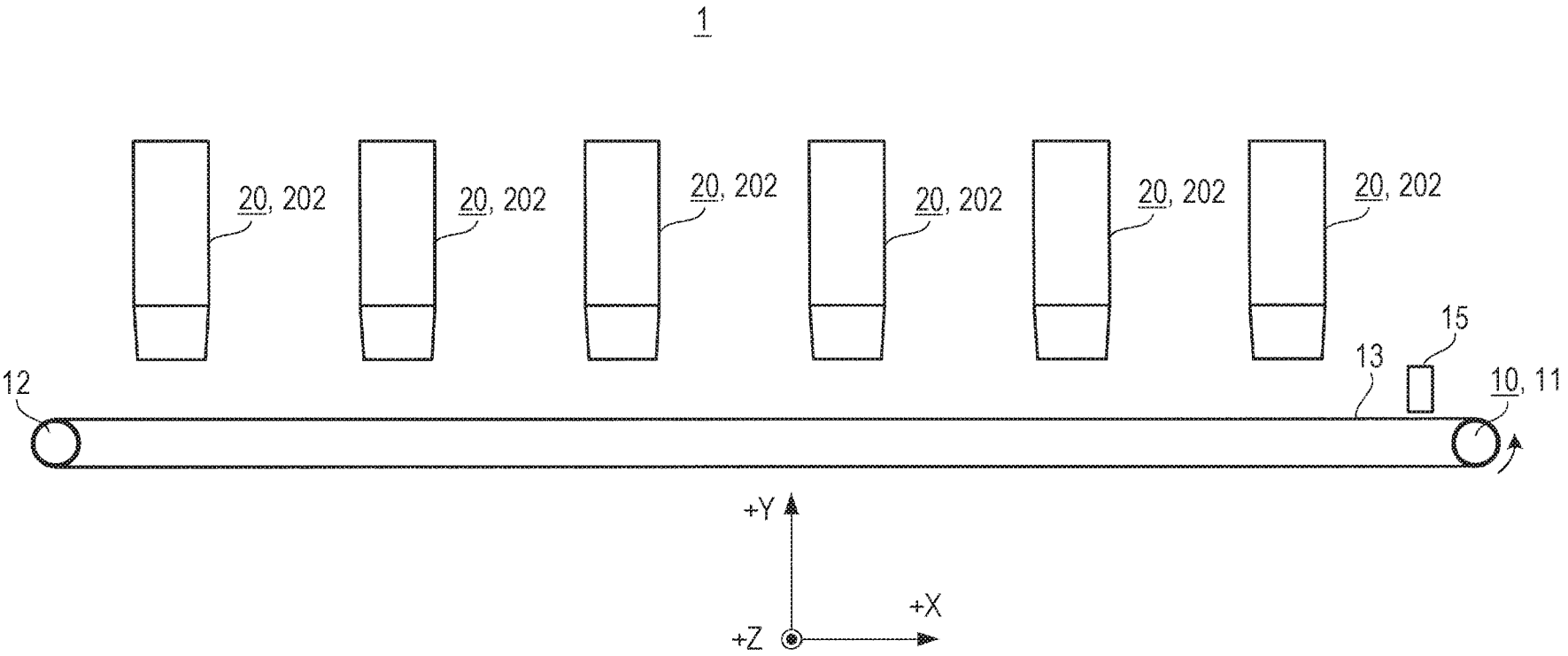
FIG. 2 is a diagram schematically showing an inkjet printing apparatus according to an embodiment of the present invention.
Figure 3:
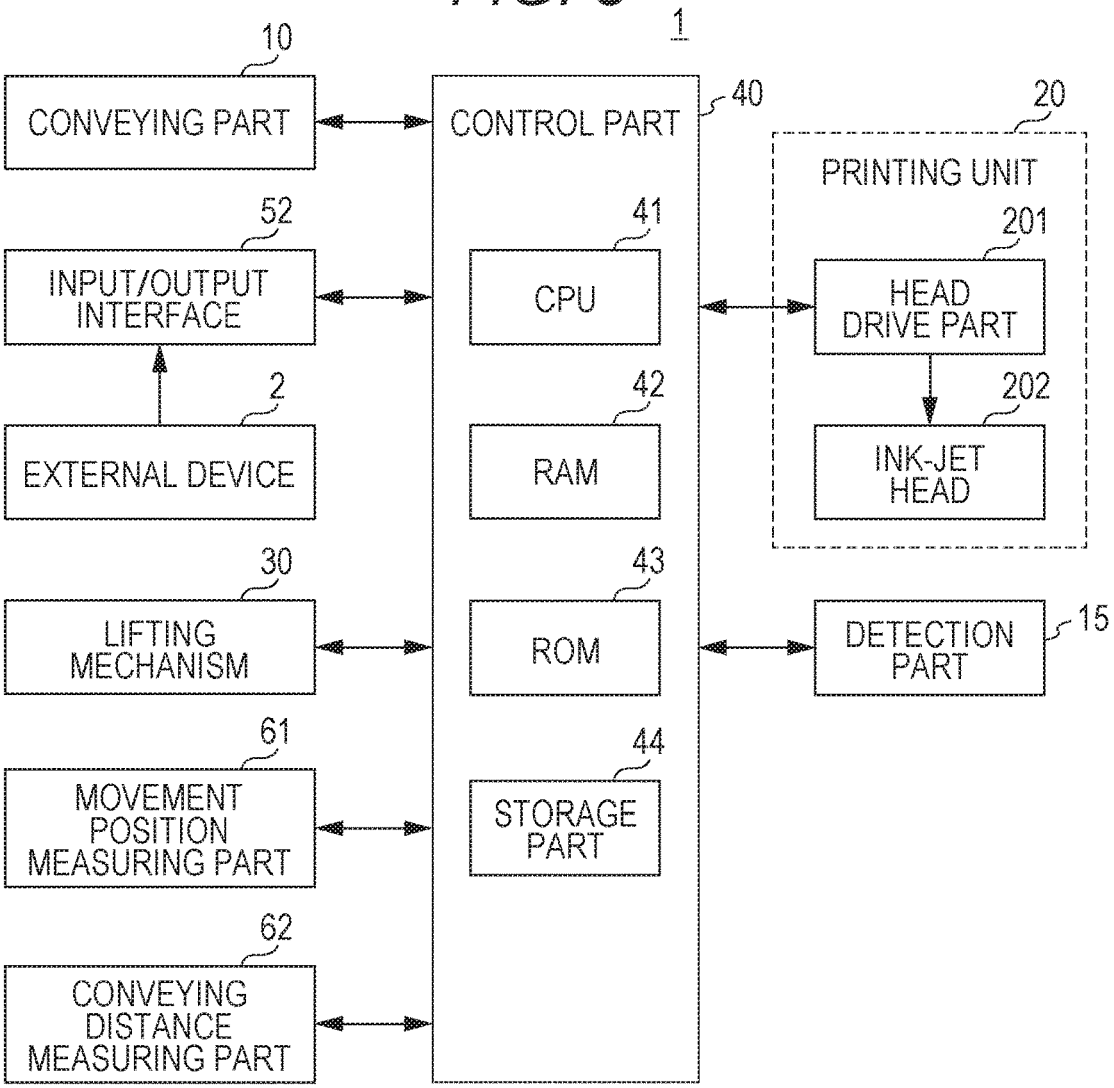
FIG. 3 is a block diagram showing a configuration of the inkjet printing apparatus.
Figure 4:
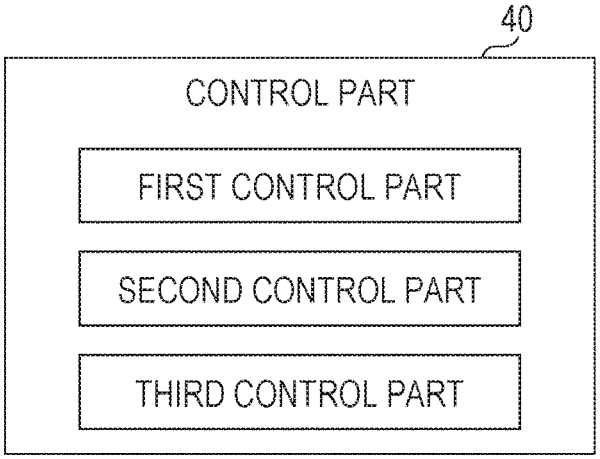
FIG. 4 is a block diagram showing a configuration of a control part.

Hereinafter, one or more embodiments of the present invention will be described with reference to the drawings. However, the scope of the invention is not limited to the disclosed embodiments. An ink-jet printing apparatus 1 according to the embodiment of the present invention will be described with reference to FIGS. 2 to 6. FIG. 2 is a diagram schematically showing the ink jet printing apparatus 1 according to the embodiment of the present invention. FIG. 3 is a block diagram showing a configuration of the ink-jet printing apparatus 1. FIG. 4 is a block diagram showing a configuration of a control part. An X-axis, a Y-axis, and a Z-axis are shown in FIG. 2. In FIG. 2, the left-right direction is referred to as an X direction or the direction of conveying a print medium (hereinafter, "conveyance direction"). The right direction is referred to as "+X direction" or the upstream side of the conveyance direction. The left direction is referred to as "−X direction" or the downstream side of the conveyance direction. Furthermore, in FIG. 2, the vertical direction is referred to as a Y direction or the height direction. The upward direction is referred to as "+Y direction" or the ascending direction. The downward direction is referred to as "−Y direction" or the descending direction. Moreover, in FIG. 2, the depth direction orthogonal to the plane of paper is referred to as a Z direction. The front direction is referred to as "+Z direction", and the back direction is referred to as "−Z direction". Note that a print medium is omitted in FIG. 2.

As shown in FIGS. 2 and 3, the ink-jet printing apparatus 1 forms an image by discharging ink onto a print medium conveyed in a predetermined direction. The ink-jet printing apparatus 1 includes a conveying part 10, a detection part 15, a printing unit 20, a lifting mechanism 30 (corresponding to a "moving part" of the present disclosure), a control part 40, a movement position measuring part 61, and a conveying distance measuring part 62.

The conveying part 10 includes a driving roller 11, a driven roller 12, and an endless conveyor belt 13 spanned between the rollers 11 and 12. For example, when the driving roller 11 is rotationally driven by a conveyance motor (not shown) attached to the driving roller 11, the conveyor belt 13 circulates around the driving roller 11 and the driven roller 12 to convey a print medium placed on the upper surface of the conveyor belt 13. Meanwhile, when rotation of the driving roller 11 is stopped, the conveyor belt 13 stops circulation to stop conveying the print medium. Here, for example, a resin film and metal can be used as the print medium, in addition to cloth and paper.

The conveying part 10 supplies a drive signal to the conveyance motor based on a control signal supplied from the control part 40 such that the conveyor belt 13 moves at a predetermined speed and timing. The control signal to be supplied from the control part 40 to the conveying part 10 includes a distance (hereinafter, print distance L1) of conveyance of a print medium to be conveyed while printing is performed based on a print job.

The detection part 15 measures a surface part of the print medium on the conveyor belt 13. Here, the surface part of the print medium refers to a set of the highest portions in each partial area of the print medium. When there is a protrusion on the print medium (for example, a seam between print media or a foreign substance), the surface part of the print medium refers to the protrusion. When there is no protrusion on the print medium, the surface part of the print medium refers to the surface of the print medium. The detection part 15 is, for example, a laser sensor that irradiates the surface part of the print medium with laser light in the horizontal direction (Z direction) orthogonal to the conveyance direction, and measures the surface part of the print medium based on a change in light quantity.

A plurality (here, six) of the printing units 20 is arranged side by side at predetermined intervals along the direction of conveying the print medium. The six printing units 20 are provided such that the six printing units 20 correspond to six colors of ink.

Each printing unit 20 includes a head drive part 201 and an ink-jet head 202 (corresponding to a "print head" of the present disclosure).

Under the control of the control part 40, the head drive part 201 outputs a drive signal to a recording element of the ink-jet head 202 at a proper timing. The drive signal causes a piezoelectric element to deform according to image data. The head drive part 201 outputs the drive signal to cause a nozzle of the ink-jet head 202 to discharge an appropriate amount of ink according to a pixel value of image data.

The ink-jet head 202 is provided with a plurality of the recording elements each including a pressure chamber that stores ink, the piezoelectric element provided on a wall surface of the pressure chamber, and the nozzle. When the drive signal that causes the piezoelectric element to deform is input to the recording element, the pressure chamber is deformed due to deformation of the piezoelectric element and thus, the pressure in the pressure chamber changes. As a result, ink is discharged from the nozzle communicating with the pressure chamber.

The arrangement range of the nozzles included in the ink-jet head 202 with respect to the orthogonal direction covers an image recording area of the print medium to be conveyed, in terms of the width in the orthogonal direction. The printing unit 20 is fixed when used for recording an image. That is, the ink jet printing apparatus 1 is a single-pass type ink-jet printing apparatus. Note that the ink-jet printing apparatus 1 may be a scan-type ink-jet printing apparatus.

The lifting mechanism 30 (moving part) supplies a drive signal to a lifting motor (not shown) based on a control signal supplied from the control part 40 to move the ink-jet head 202 in the height direction (vertical direction). The control signal to be supplied from the control part 40 to the lifting mechanism 30 includes the moving direction (upward/downward) and moving amount of the ink jet head 202. The lifting mechanism 30 moves the ink-jet head 202 in the height direction to move the ink jet head 202 toward or away from the print medium on the conveyor belt 13.

Figure 5A:
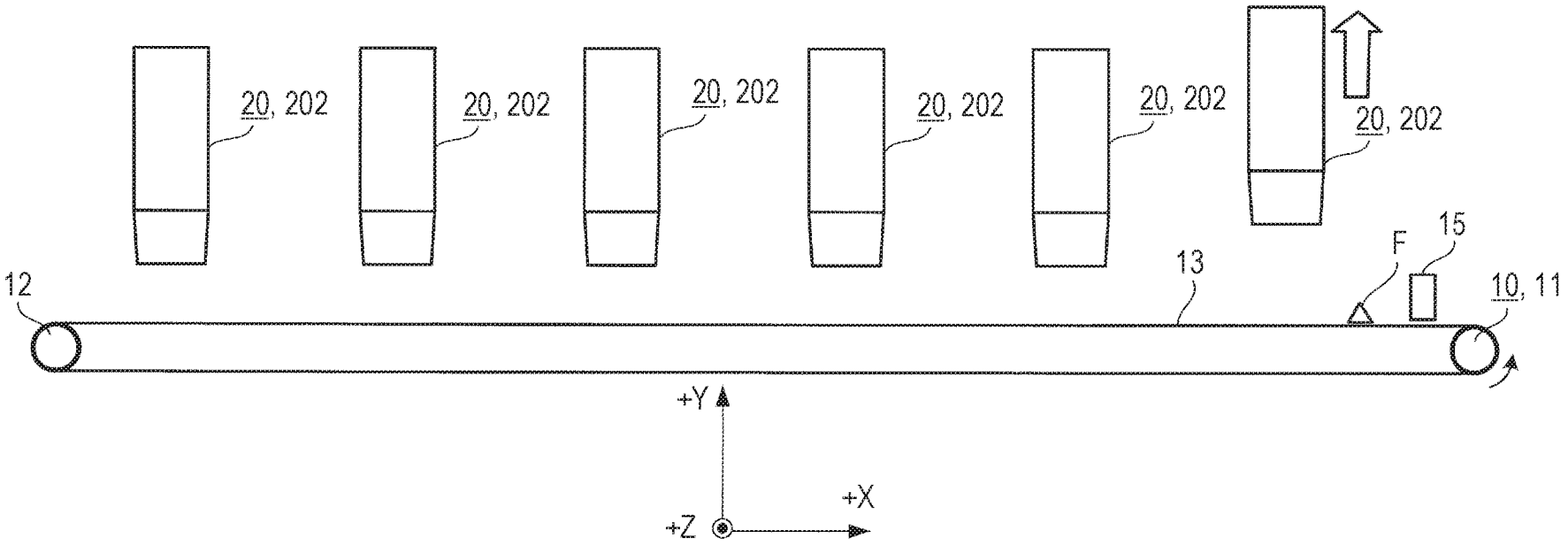
FIG. 5A is a diagram showing an ink-jet head moving in the height direction.
Figure 5B:
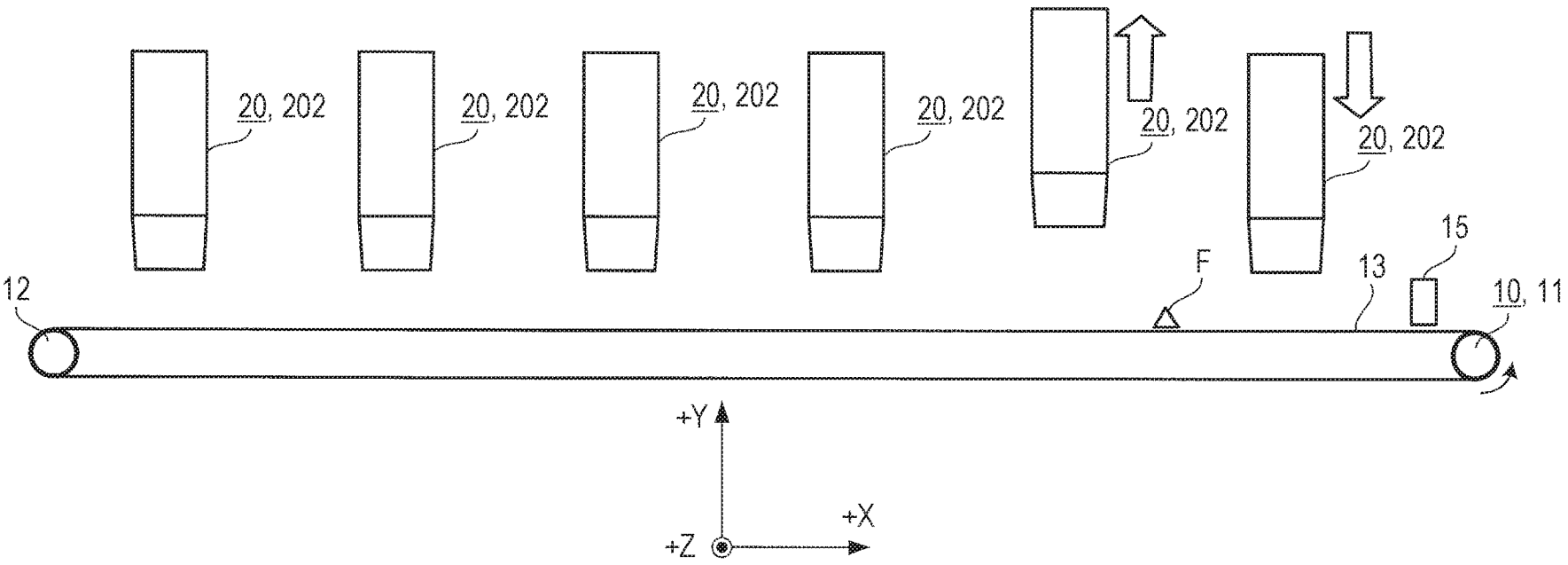
FIG. 5B is a diagram showing the ink jet heads moving in the height direction.

FIGS. 5A and 5B are diagrams showing the ink-jet heads 202 moving in the height direction. Note that the print medium is omitted in FIGS. 5A and 5B. FIG. 5A shows a situation in which the ink jet head 202 closest to the upstream end in the conveyance direction moves upward. FIG. 5B shows a situation in which the ink-jet head 202 closest to the upstream end in the conveyance direction moves downward and the ink-jet head 202 second closest to the upstream end moves upward.

As can be seen from FIGS. 5A and 5B, the lifting mechanism 30 moves the ink jet head 202 upward from the normal position to the standby position before a foreign substance F passes below the ink-jet head 202 while the print medium is conveyed. Then, after the foreign substance F has passed below the ink-jet head 202, the lifting mechanism 30 moves ink jet head 202 downward from the standby position to the normal position. That is, the lifting mechanism 30 moves the ink jet head 202 away from the print medium according to the distance between the surface part of the print medium (a seam between print media, a foreign substance on the print medium, or the like) and the ink-jet head 202. Furthermore, for example, the lifting mechanism 30 can make adjustments such that the nozzles of the inkjet head 202 are located at a height suitable for printing in accordance with different thicknesses of various print media.

The control part 40 includes a central processing unit (CPU) 41, a random access memory (RAM) 42, a read only memory (ROM) 43, and a storage part 44.

The CPU 41 reads various control programs and setting data stored in the ROM 43, stores the read programs and setting data in the RAM 42, and executes the programs to implement each function of the control part 40. In addition, the CPU 41 centrally controls the overall operation of the ink-jet printing apparatus 1. Here, each function of the control part 40 is implemented by each of, for example, a first control part, a second control part, and a third control part, as shown in FIG. 4. The first control part, the second control part, and the third control part may be integrally formed by a single CPU or may be separately formed by respective CPUs.

The RAM 42 provides a working memory space to the CPU 41, and stores temporary data. Note that the RAM 42 may include a non-volatile memory.

The ROM 43 stores the various control programs to be executed by the CPU 41, the setting data, and the like. Note that a rewritable non-volatile memory such as an electrically erasable programmable read-only memory (EEPROM) or a flash memory may be used instead of the ROM 43.

A print job (including various types of user setting information such as the print distance L1) input from an external device 2 via an input/output interface 52 and image data relating to the print job are stored in the storage part 44. For example, a hard disk drive (HDD) is used as the storage part 44, and a dynamic random access memory (DRAM) or the like may be used together.

The input/output interface 52 mediates data transmission between the external device 2 and the control part 40. The input/output interface 52 includes, for example, any of various serial interfaces and various parallel interfaces, or a combination thereof.

The external device 2 is, for example, a personal computer, and supplies a print job, image data, and the like to the control part 40 via the input/output interface 52.

Incidentally, the lifting mechanism 30 moves the ink-jet head 202 upward in accordance with the distance between the surface part of the print medium (for example, a seam between print media and a foreign substance on the print medium) and the ink-jet head 202. As a result, it is possible to avoid interference between a seam or the like and the ink-jet head 202. However, the distance between the print medium and the ink-jet head 202 becomes larger than the set distance. In the case where the distance between the print medium and the ink-jet head 202 is larger than the set distance, printing on the print medium may lead to deterioration in image quality. There is a problem in that a target print amount with normal image quality cannot be achieved due to partial deterioration in image quality.

Therefore, the ink-jet printing apparatus 1 according to the present embodiment includes the movement position measuring part 61 and the conveying distance measuring part 62.

The movement position measuring part 61 measures the distance between the print medium and the ink-jet head 202. Furthermore, the movement position measuring part 61 measures the distance between the surface part of the print medium and the ink-jet head 202.

The conveying distance measuring part 62 measures the conveying distance of the print medium conveyed by the conveying part 10. Note that, for example, the conveying distance measuring part 62 may measure the conveying distance based on the rotation amount of the conveyance motor or based on a control signal supplied from the control part 40 to the conveyance motor.

The conveying distance measuring part 62 measures a conveying distance L2 (head shunt conveying distance) that is the conveying distance of the print medium conveyed by the conveying part 10 while the distance between the print medium and the ink-jet head 202 is equal to or greater than a first threshold.

The control part 40 (first control part) corrects the print distance L1 based on the conveying distance L2. Specifically, the control part 40 adds the conveying distance L2 to the print distance L1, and updates the print distance L1 with a value obtained as a result of the addition. The control part 40 controls the conveying part 10 based on the updated print distance L1.

Figure 6:
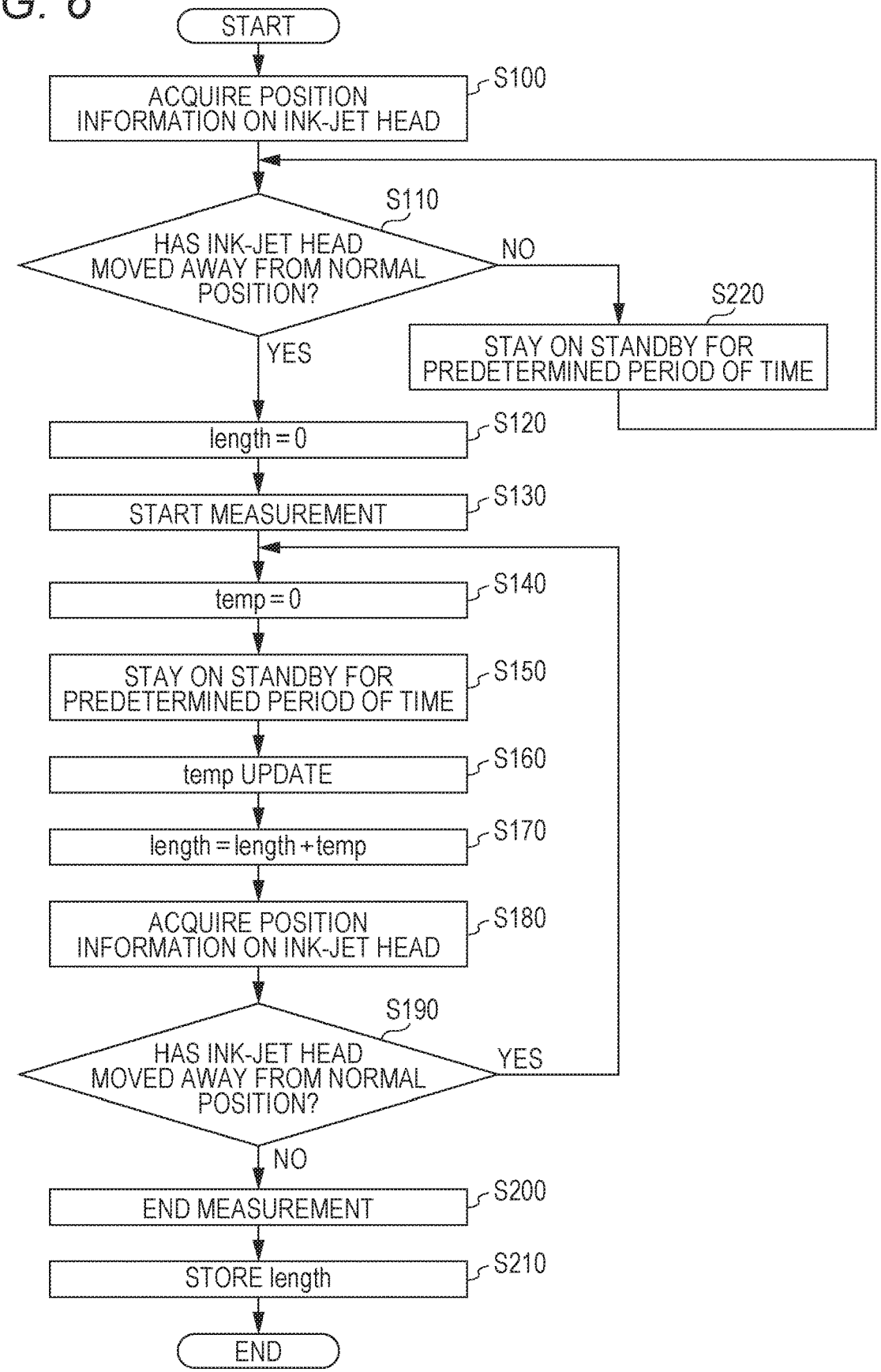
FIG. 6 is a flowchart showing an example of a printing process.

Next, an example of a printing process will be described with reference to FIG. 6. FIG. 6 is a flowchart showing an example of the printing process. This flow is started in response to the start of a print job. Note that described here is a case where when the ink-jet head 202 moves away from the normal position even a little, the print distance L1 is corrected based on the conveying distance L2 of the print medium conveyed while the ink-jet head 202 is located away from the normal position.

First, in step S100, the control part 40 acquires position information on the ink jet head 202.

Next, in step S110, the control part 40 determines whether the ink jet head 202 has moved away from the normal position. When the ink-jet head 202 has moved away from the normal position (step S110: YES), the process proceeds to step S120. When the ink-jet head 202 has not moved away from the normal position (step S110: NO), the process proceeds to step S220.

In step S120, the control part 40 initializes a print distance (length=0).

Next, in step S130, measurement of a conveying distance is started.

Next, in step S140, the control part 40 initializes the measurement value (temp=0).

Next, in step S150, the control part 40 stays on standby for a predetermined period of time (for example, a second).

Next, in step S160, the control part 40 updates the measurement value (temp update).

Next, in step S170, the control part 40 adds the measurement value to the print distance (length=length+temp).

Next, in step S180, the control part 40 acquires the position information on the ink jet head 202.

Next, in step S190, the control part 40 determines whether the ink-jet head 202 has moved away from the normal position. When the ink-jet head 202 has moved away from the normal position (step S190: YES), the process proceeds to a point before step S140. When the ink-jet head 202 has not moved away from the normal position (step S190: NO), the process proceeds to step S200.

In step S200, measurement of the conveying distance ends.

Next, in step S210, the control part 40 stores the print distance in the storage part 44. Then, the process shown in FIG. 6 ends.

In step S220, the control part 40 stays on standby for a predetermined period of time (for example, a second) Then, the process returns to a point before step S110.

The ink-jet printing apparatus 1 according to the above-described embodiment includes the conveying part 10, the plurality of ink-jet heads 202, the lifting mechanism 30, and the control part 40. The conveying part 10 conveys a print medium. The plurality of ink-jet heads 202 is arranged along the direction of conveyance of the print medium, and discharges ink onto the print medium to perform printing on the print medium. The lifting mechanism 30 moves the ink-jet heads 202 in such a way as to change the distances between the print medium and the ink-jet heads 202. The control part 40 performs control such that the print medium is conveyed based on the predetermined print distance L1, and corrects the print distance L1 in response to the ink-jet heads 202 being moved in such a way as to change the distances between the ink-jet heads 202 and the print medium. Thus, as a result of moving the ink-jet heads 202 such that the distances between the ink-jet heads 202 and the print medium are changed from the set distance, the print distance L1 is corrected based on the movement of the ink-jet heads 202. Therefore, it is possible to achieve a target print amount with normal image quality even in the case of partial deterioration in image quality.

First Modified Example

Figure 7:
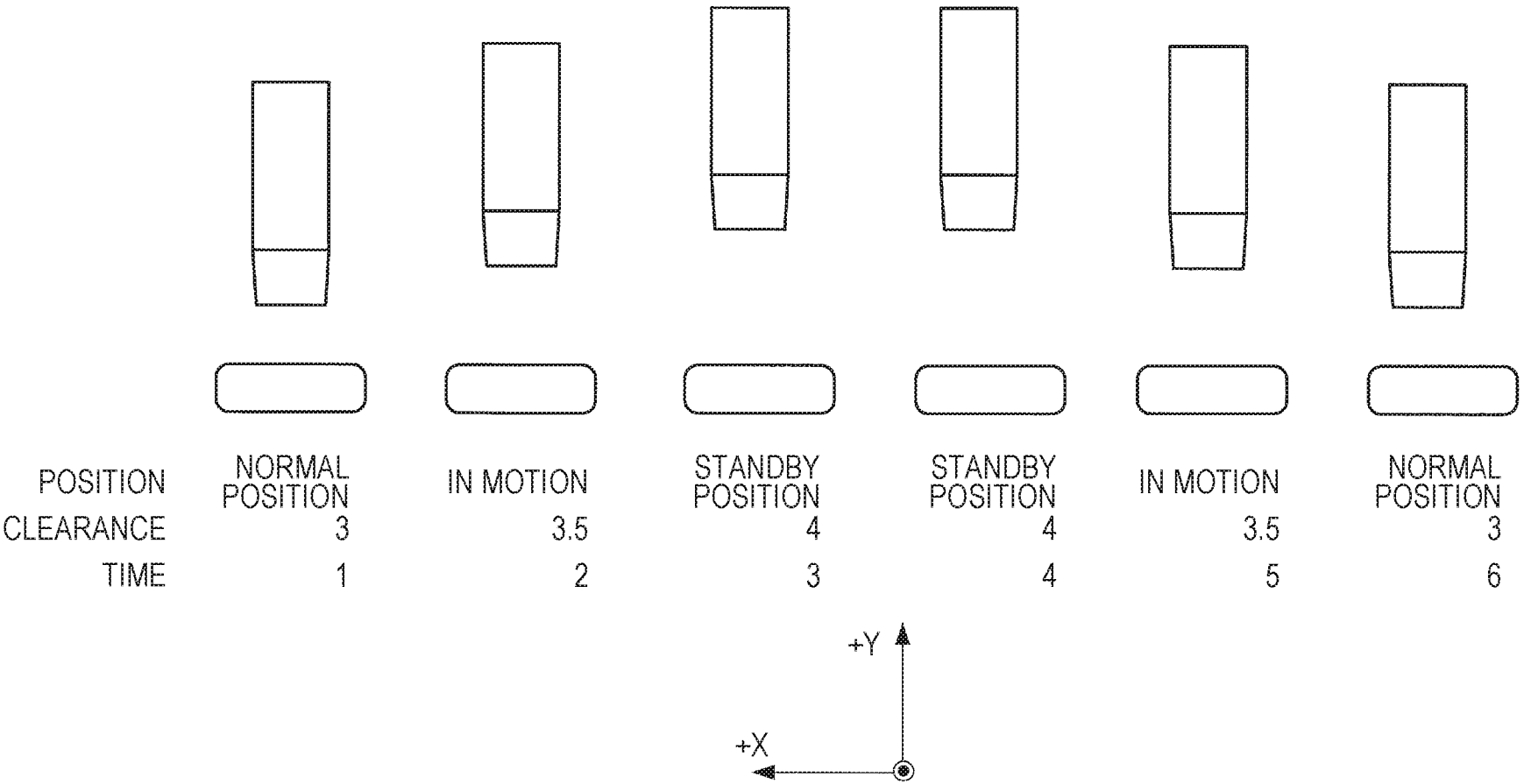
FIG. 7 is a diagram showing a relationship between a distance between a print medium and the ink-jet head and time in a first modified example.
Figure 8:
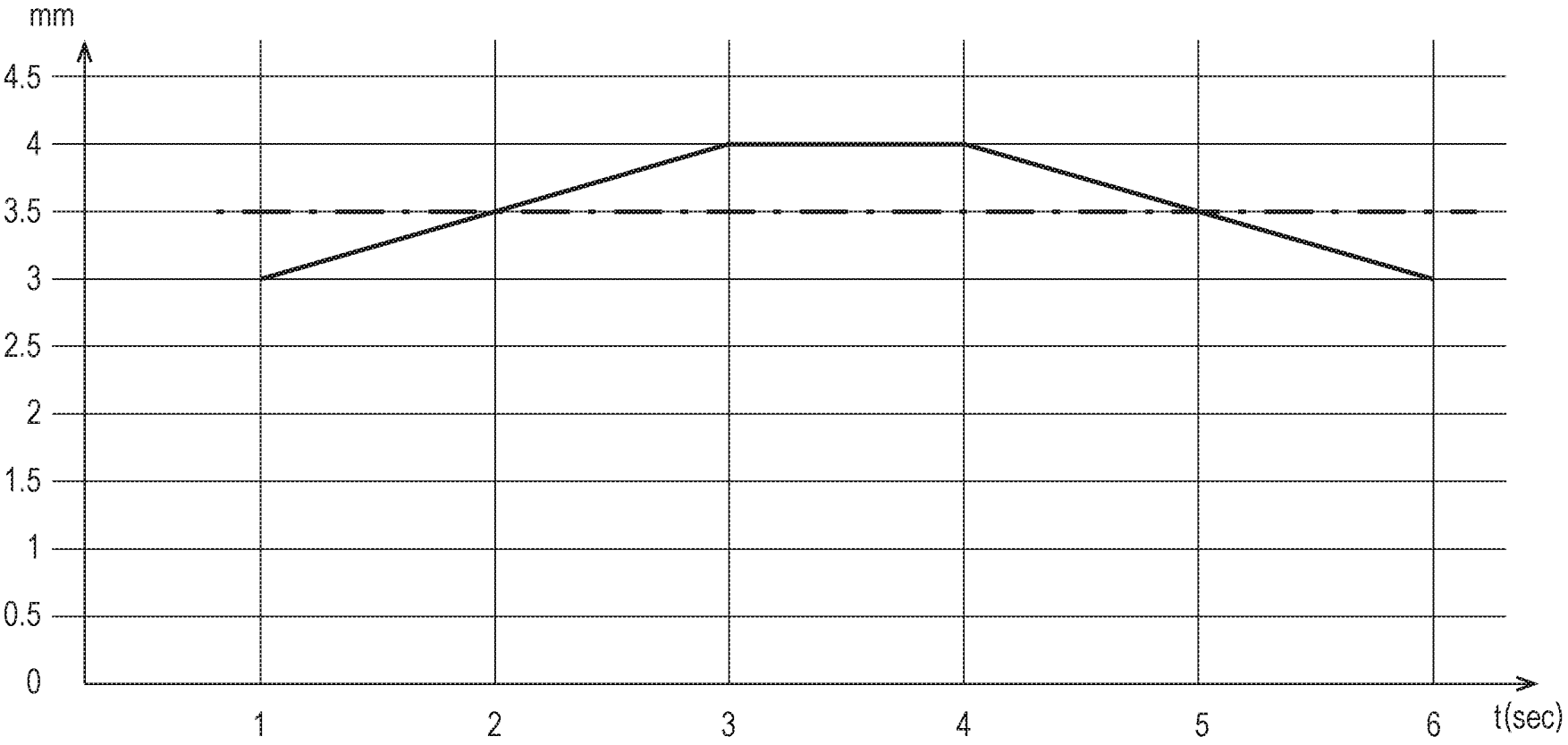
FIG. 8 is a graph showing the relationship between the distance between the print medium and the ink-jet head and time in the first modified example.

Next, a first modified example of the present embodiment will be described with reference to FIGS. 7 and 8. FIG. 7 is a diagram showing the relationship between the distance between a print medium and an ink-jet head 202 and time. FIG. 8 is a graph showing the relationship between the distance between the print medium and the ink-jet head 202 and time. In FIG. 8, time t (sec) is on the horizontal axis, and the distance (mm) between the print medium and the ink-jet head 202 is on the vertical axis.

As shown in FIGS. 7 and 8, the distance between the print medium and the ink jet head 202 is 3 mm at time 1, 3.5 mm at time 2, 4 mm at time 3, 4 mm at time 4, 3.5 mm at time 5, and 3 mm at time 6.

In the first modified example, it is presumed that image quality partially deteriorates when the distance between the print medium and the ink-jet head 202 is equal to or greater than a first threshold (for example, 3.5 mm). Therefore, the distance (conveying distance L2) of conveyance of the print medium to be conveyed during a period of time in which the distance between the print medium and the ink jet head 202 is equal to or greater than the first threshold (elapsed time from time 2 to time 5 shown in FIGS. 7 and 8, that is, 3 seconds) corresponds to the length of a portion with image quality that is considered likely to deteriorate. Note that the first threshold can be obtained by experiments or simulations.

The movement position measuring part 61 measures the distance between the print medium and the ink-jet head 202. A control part 40 determines whether the measured distance between the print medium and the ink-jet head 202 is equal to or greater than the first threshold. A conveying distance measuring part 62 multiplies the above-described period of time (for example, 3 seconds) by the speed of conveying the print medium (capable of being calculated based on, for example, the rotation speed of a conveyance motor) to calculate the conveying distance L2 (the length of the portion with image quality that is considered likely to deteriorate). The control part 40 adds the conveying distance L2 to a print distance L1, and updates the print distance L1 with a value obtained as a result of the addition.

In the first modified example, it has been presumed that image quality partially deteriorates when the distance between the print medium and the ink jet head 202 is equal to or greater than the first threshold. This enables calculation of the conveying distance L2 (the length of the portion with image quality that is considered likely to deteriorate). It is thus possible to surely achieve a target print amount with normal image quality by correcting the print distance L1 based on the conveying distance L2.

Note that the control part 40 may receive an external input for changing the first threshold via an input receiving part (not shown) that receives a user input. This allows the user to change the first threshold according to printing conditions (for example, the type of print medium). Note that the first threshold corresponding to the printing conditions can be obtained by experiments or simulations.

In the first modified example, the control part 40 performs control in such a way as to move the ink-jet head 202 based on the distance between the print medium and the inkjet head 202, measured by the movement position measuring part 61. Specifically, in the case where, for example, a foreign substance F is detected, the control part 40 (second control part) controls a lifting mechanism 30 based on the result of measurement performed by the movement position measuring part 61 such that the distance between the print medium and the ink-jet head 202 becomes equal to or greater than the first threshold. As a result, it is possible to surely move the ink-jet head 202 away from the foreign substance.

Second Modified Example

Figure 9:
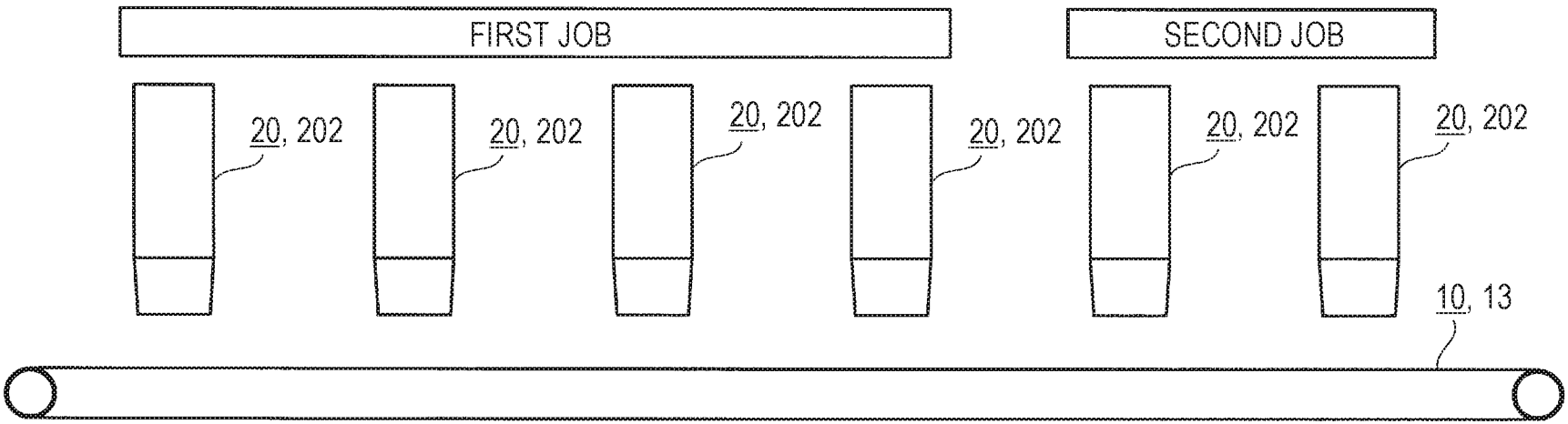
FIG. 9 is a diagram schematically showing an inkjet printing apparatus according to a second modified example.

Next, a second modified example of the present embodiment will be described with reference to FIGS. 9 and 10. FIG. 9 is a diagram schematically showing an ink-jet printing apparatus 1 according to the second modified example. For example, in the case where ink jet heads 202 first and second closest to the upstream end in a conveyance direction have proceeded to a second job while ink-jet heads 202 third to sixth closest to the upstream end are still performing a first job as shown in FIG. 9, it is not possible to configure the setting for correcting a print distance L1 for the first job even in a situation in which the print distance L1 is to be corrected. For example, in order to correct the print distance L1 during printing, either of the following conditions needs to be satisfied: there remains a length corresponding to a value obtained as a result of multiplying the distance between the adjacent ink-jet heads 202 by the number of colors (here, six colors), or there remains a portion with a certain length yet to be printed at the ink-jet head 202 closest to the upstream end.

The print distance L1 cannot be corrected not only in the case described above, but also in other cases depending on the progress of a printing process.

Therefore, in the second modified example, a control part 40 determines whether the necessary conditions for correcting the print distance L1 are satisfied. The control part 40 corrects tile print distance L1 based on the result of determination. In the second modified example, the necessary conditions include a second threshold that serves as a criterion for determining the progress of the printing process. Examples of the second threshold include a threshold A [m] to a threshold D [m] shown in FIG. 10.

Figure 10:
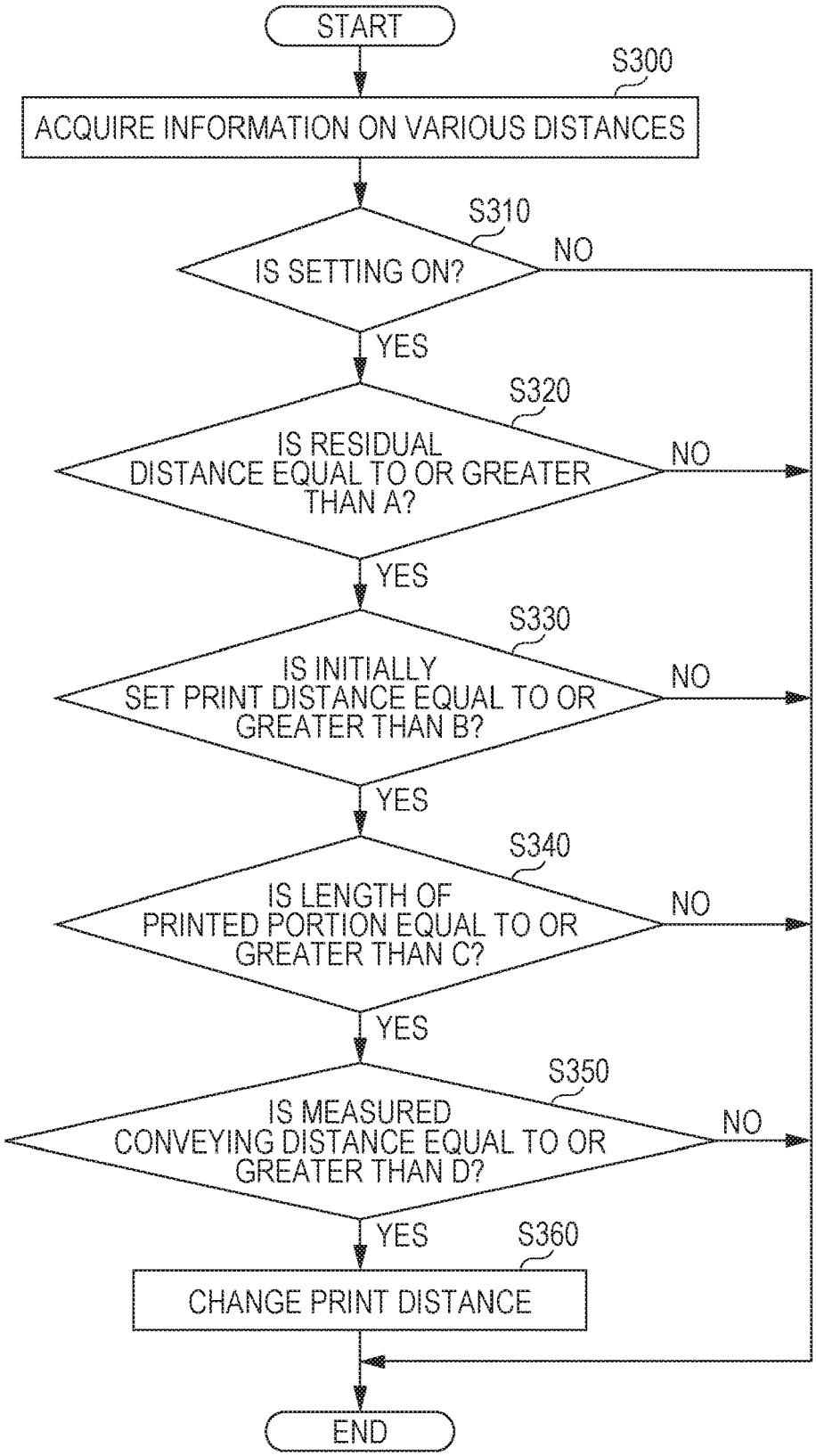
FIG. 10 is a flowchart showing an example of a printing process in the second modified example.

FIG. 10 is a flowchart showing an example of the printing process in the second modified example. This flow is started in response to the start of a print job.

First, in step S300, the control part 40 acquires information on various distances. Here, the various distances refer to the initially set print distance L1, a residual distance, the length of a printed portion, and a conveying distance L2. The residual distance is a value obtained by subtraction of the length of the printed portion from the print distance L1. In addition, the conveying distance L2 is the conveying distance of a print medium to be conveyed while the distance between the print medium and the ink jet head 202 is equal to or greater than a first threshold.

Next, in step S310, the control part 40 determines whether the setting for correcting the print distance L1 is on. When the setting for correcting the print distance L1 is on (step S310: YES), the process proceeds to step S320. When the setting for correcting the print distance L1 is not on (step S310: NO), the process shown in FIG. 10 ends.

In step S320, the control part 40 determines whether the residual distance is equal to or greater than the threshold A. When the residual distance is equal to or greater than the threshold A (step S320: YES), the process proceeds to step S330. When the residual distance is not equal to or greater than the threshold A (step S320: NO), the process shown in FIG. 10 ends.

In step S330, the control part 40 determines whether the initially set print distance L1 is equal to or greater than the threshold B. When the initially set print distance L1 is equal to or greater than the threshold B (step S330: YES), the process proceeds to step S340. When the initially set print distance L1 is not equal to or greater than the threshold B (step S330: NO), the process shown in FIG. 10 ends.

In step S340, the control part 40 determines whether the length of the printed portion is equal to or greater than the threshold C. When the length of the printed portion is equal to or greater than the threshold C (step S340: YES), the process proceeds to step S350. When the length of the printed portion is not equal to or greater than the threshold C (step S340: NO), the process shown in FIG. 10 ends.

In step S350, the control part 40 determines whether the measured conveying distance L2 is equal to or greater than the threshold D. When the conveying distance L2 is equal to or greater than the threshold D (step S350: YES), the process proceeds to step S360. When the conveying distance L2 is not equal to or greater than the threshold D (step S350: NO), the process shown in FIG. 10 ends.

In step S360, the control part 40 corrects the print distance L1. Then, the process shown in FIG. 10 ends.

According to the second modified example, the print distance L1 is corrected when the necessary conditions for correcting the print distance L1 are satisfied. Accordingly, it is possible to achieve a target print amount with normal image quality based on highly reliable information.

Note that, in the second modified example above, the control part 40 receives an external input for changing the print distance L1 via an input receiving part (not shown) that receives a user input. The control part 40 determines whether the setting for correcting the print distance L1 is on. When the setting for correcting the print distance L1 is on, the print distance L1 can be corrected, and when the setting for correcting the print distance L1 is off, the print distance L1 cannot be corrected. Alternatively, in the present invention, the control part 40 may accept correction of the print distance L1 based on the operating state of the ink-jet head 202 (operating state such as an error, job interruption, or printing). This allows a user to select a situation in which the print distance L1 is to be corrected.

In addition, the above-described embodiment is merely an example of an embodiment for carrying out the present invention, and the technical scope of the present invention should not be restrictively interpreted. That is, the present invention can be implemented in various forms without departing from the gist or main features thereof.

Note that, in the above embodiment, the control part 40 (third control part) may receive an external input for choosing whether to discharge ink when the distance between the print medium and the ink jet head 202 is equal to or greater than the first threshold. Here, the control part 40 receives the external input for choosing whether to discharge ink via the input receiving part that receives a user input. As a result, it is possible to reduce the amount of ink consumption in the case of choosing not to discharge ink.

Furthermore, in the above embodiment, some users do not desire to add the distance of conveyance of the print medium to the print distance L1 even in the case where the print medium is conveyed while discharge of ink is temporarily stopped. Therefore, the control part 40 receives an external input for choosing whether to add, to the conveying distance L2, a discharge interruption distance that is the conveying distance of the print medium conveyed while discharge of ink is temporarily stopped. As a result, it is possible to meet the user's demand.

In addition, when a temporary stop is continued for a certain period of time or more during printing, image quality may differ from that in the case of continuing printing, due to a difference in permeation of ink or drying time. For example, assume that some portion has been printed only in a first color in the printing unit 20. Time that elapses before printing in a second color is performed is different from usual. Therefore, the first color ink penetrates more than usual. As a result, image quality may be different from that in the case where printing is continued. Furthermore, for example, when drying time becomes longer, urea may react to cause yellowing, leading to different image quality. Therefore, when discharge of ink is stopped for a predetermined period of time or more, the control part 40 receives an external input for choosing whether to add a predetermined distance to the print distance L1. The predetermined period of time can be obtained by experiments or simulations. As a result, it is possible to achieve a print amount with normal image quality. Note that, during the period of time in which ink is not discharged, the ink-jet head 202 may be or need not be moved such that the distance between the print medium and the ink-jet head 202 is changed from the set distance. Furthermore, the predetermined distance described above may be added to the conveying distance L2. This is because adding the predetermined distance described above to the conveying distance L2 results in adding the predetermined distance to the print distance L1.

Figure 11:
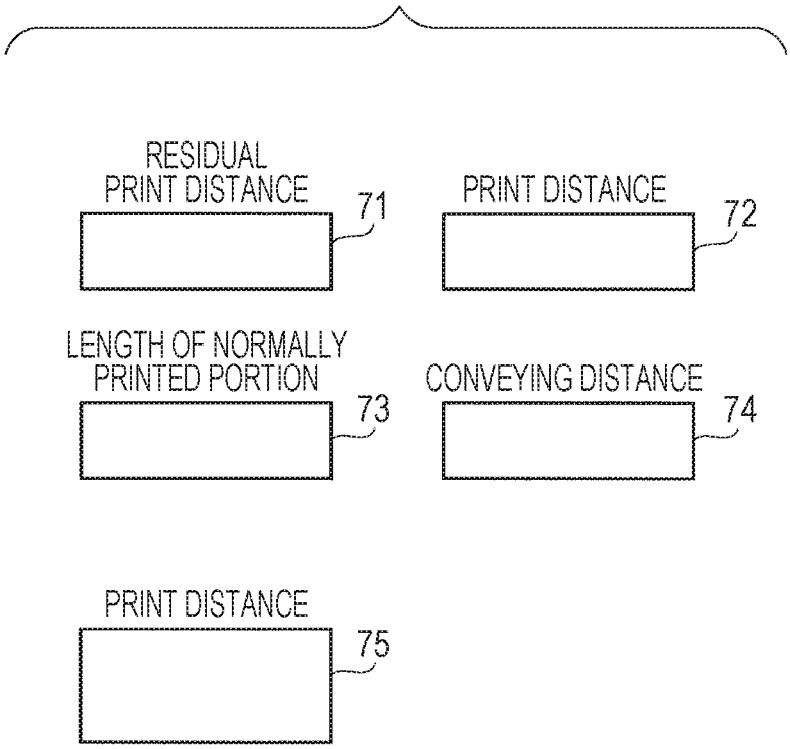
FIG. 11 is a diagram showing examples of screens showing the progress of a printing process.

Note that, in the above embodiment, a display part (not shown) of the ink-jet printing apparatus 1 may display a screen showing the progress of the printing process. As shown in FIG. 11, a screen 71, a screen 72, a screen 73, and a screen 74 are displayed on the display part. The screen 71 displays a residual print distance. The screen 72 displays the print distance L1 (including a print distance corrected based on the conveying distance L2). The screen 73 displays the length of a normally printed portion. The screen 74 displays a conveying distance (conveying distance measured by the conveying distance measuring part 62). Information displayed on each screen enables a user to visually recognize the progress of the printing process with ease.

Furthermore, the control part 40 may receive an external input for correcting the print distance L1 via an input dialog box 75 (input receiving part) that receives a user input. This enables the user to check the degree of image quality and input, as the print distance L1, the length of a portion with image quality deemed to be deteriorated into the input dialog box 75.

Note that when a single design or pattern is continuously repeated in the conveyance direction in the above embodiment, it is also possible to calculate the conveying distance L2 by using, as a unit, the length of the single design or pattern in the conveyance direction such that the conveying distance L2 is expressed by the number of units.

Although embodiments of the present invention have been described and illustrated in detail, the disclosed embodiments are made for purposes of illustration and example only and not limitation. The scope of the present invention should be interpreted by terms of the appended claims.

What is claimed is:

1. An ink-jet printing apparatus comprising:

a conveying part that conveys a print medium;

a plurality of discharge heads that are arranged along a direction of conveying the print medium, and discharge ink onto the print medium to perform printing on the print medium;

a moving part that moves the discharge heads such that distances between the print medium and the discharge heads are changed from a set distance; and a hardware processor that controls printing on the print medium, to be performed by the discharge heads, wherein:

the hardware processor corrects a print distance such that the print distance is changed from a predetermined value in response to the discharge heads being moved in such a way as to change the distances between the print medium and the discharge heads, the print distance being a conveying distance of the print medium to be conveyed while printing on the print medium is performed by the discharge heads, the hardware processor corrects the print distance when the distances between the print medium and the discharge heads are equal to or greater than a first threshold, the ink-jet printing apparatus further comprises:

a conveying distance measuring part that measures a head shunt conveying distance that is a conveying distance of the print medium conveyed while the distances between the print medium and the discharge heads are equal to or greater than the first threshold, and the hardware processor corrects the print distance by adding the measured head shunt conveying distance to the predetermined value to obtain the corrected print distance.

2. The ink-jet printing apparatus according to claim 1, wherein the hardware processor receives an external input for correcting the print distance.

3. The ink-jet printing apparatus according to claim 2, wherein the hardware processor receives the external input for correcting the print distance based on operating states of the discharge heads.

4. The ink-jet printing apparatus according to claim 2, wherein the hardware processor determines whether a necessary condition for correcting the print distance is satisfied.

5. The ink-jet printing apparatus according to claim 4, wherein the hardware processor determines whether the necessary condition is satisfied, based on progress of a printing process.

6. The ink-jet printing apparatus according to claim 2, wherein the hardware processor receives the external input via an input receiving part that receives a user input.

7. The ink-jet printing apparatus according to claim 1, further comprising:

a movement position measuring part that measures distances between a surface part of the print medium and the discharge heads, wherein the hardware processor performs control in such a way as to move the discharge heads based on the measured distances between the surface part of the print medium and the discharge heads.

8. The ink-jet printing apparatus according to claim 1, wherein the hardware processor accepts a change of the first threshold.

9. The ink-jet printing apparatus according to claim 1, wherein the discharge heads discharge ink onto the print medium to form an image, and the hardware processor receives an external input for choosing whether to discharge the ink when the distances between the print medium and the discharge heads are equal to or greater than the first threshold.

10. The ink-jet printing apparatus according to claim 1, wherein the discharge heads discharge ink onto the print medium to form an image, and the hardware processor receives an external input for choosing whether to add a discharge interruption conveying distance to the head shunt conveying distance, the discharge interruption conveying distance being a conveying distance of the print medium conveyed while discharge of the ink is temporarily stopped.

11. The ink-jet printing apparatus according to claim 1, wherein the discharge heads discharge ink onto the print medium to form an image, and the hardware processor receives an external input for choosing whether to add a predetermined distance to the print distance when discharge of the ink is stopped for a predetermined period of time or more.

12. A print control method to be performed in an ink-jet printing apparatus including: a conveying part that conveys a print medium; a plurality of discharge heads that are arranged along a direction of conveying the print medium, and discharge ink onto the print medium to perform printing on the print medium; and a moving part that moves the discharge heads such that distances between the print medium and the discharge heads are changed from a set distance, the method comprising:

moving the plurality of discharge heads in such a way as to change the distances between the print medium and the plurality of discharge heads; and correcting a print distance such that the print distance is changed from a predetermined value in response to the plurality of discharge heads being moved in such a way as to change the distances between the print medium and the discharge heads, the print distance being a conveying distance of the print medium to be conveyed while printing on the print medium is performed by the discharge heads, wherein the correcting the print distance comprises correcting the print distance when the distances between the print medium and the discharge heads are equal to or greater than a first threshold, wherein the method further comprises measuring a head shunt conveying distance that is a conveying distance of the print medium conveyed while the distances between the print medium and the discharge heads are equal to or greater than the first threshold, and wherein the correcting the print distance comprises correcting the print distance by adding the measured head shunt conveying distance to the predetermined value to obtain the corrected print distance.

13. A non-transitory recording medium storing a computer readable program causing a computer to perform:

moving discharge heads that are arranged along a direction of conveying a print medium, and discharge ink onto the print medium to perform printing on the print medium, wherein the moving of the discharge heads is performed such that distances between the discharge heads and the print medium are changed from a set distance; and correcting a print distance such that the print distance is changed from a predetermined value in response to the discharge heads being moved in such a way as to change the distances between the discharge heads and the print medium, the print distance being a conveying distance of the print medium to be conveyed while printing on the print medium is performed by the discharge heads, wherein the correcting the print distance comprises correcting the print distance when the distances between the print medium and the discharge heads are equal to or greater than a first threshold, wherein the program causes the computer to further perform measuring a head shunt conveying distance that is a conveying distance of the print medium conveyed while the distances between the print medium and the discharge heads are equal to or greater than the first threshold, and wherein the correcting the print distance comprises correcting the print distance by adding the measured head shunt conveying distance to the predetermined value to obtain the corrected print distance.

* * * * *